US006955612B2

(12) United States Patent
Lu

(10) Patent No.: US 6,955,612 B2
(45) Date of Patent: Oct. 18, 2005

(54) GOLF CLUB HEAD AND MANUFACTURING METHOD THEREFOR

(75) Inventor: Yuan-Ping Lu, Taoyuan (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 0 days.

(21) Appl. No.: 10/445,960

(22) Filed: May 28, 2003

(65) Prior Publication Data

US 2004/0224790 A1 Nov. 11, 2004

(51) Int. Cl.[7] ..... A63B 53/04; B23K 26/00; B23P 17/00

(52) U.S. Cl. ..... 473/324; 473/345; 473/346; 473/349; 473/409; 219/121.69; 219/121.85; 219/121.59; 29/527.6

(58) Field of Search ..... 219/121.69, 121.85, 219/121.59; 29/527.6; 473/324, 409, 342, 345, 346, 349, 339, 332

(56) References Cited

U.S. PATENT DOCUMENTS 4,429,879 A * 2/1984 Schmidt ..... 473/346
4,438,931 A * 3/1984 Motomiya ..... 473/346
5,328,176 A * 7/1994 Lo ..... 473/342
5,419,559 A * 5/1995 Melanson et al. ..... 473/346
5,431,396 A * 7/1995 Shieh ..... 473/329
5,467,983 A * 11/1995 Chen ..... 473/342
5,624,331 A * 4/1997 Lo et al. ..... 473/345
5,669,827 A * 9/1997 Nagamoto ..... 473/345
5,997,415 A * 12/1999 Wood ..... 473/346
6,089,070 A * 7/2000 Hancock et al. ..... 72/340
6,162,133 A * 12/2000 Peterson ..... 473/345
6,368,233 B1 * 4/2002 Chen ..... 473/342

* cited by examiner

*Primary Examiner*—Sebastiano Passaniti
(74) *Attorney, Agent, or Firm*—Bacon & Thomas, PLLC

(57) ABSTRACT

A manufacturing method for a golf club head. The method includes the steps of: casting a cast body provided with a recession thereon; cutting the cast body to form with at least one cut opening in the recession on the golf club head; adhering a carbon-fiber plate to the recession to seal the cut opening; defining a buffer groove between the carbon-fiber plate and the cast body; and filling with an elastic material into the buffer groove; processing the cast body to an end product.

8 Claims, 10 Drawing Sheets

GOLF CLUB HEAD AND MANUFACTURING METHOD THEREFOR

BACKGROUND OF THE INVENTION

1. Field of the Invention

The present invention is related to a golf club head and a manufacturing method therefor. More particularly, the present invention is related to a cast body of the golf club head provided with a recession and a cut opening formed therein that increases more precision of the golf club head and the manufacturing method therefor.

2. Description of the Related Art

A conventional golf club head, as shown in FIGS. 15 and 16, mainly includes a main body 10 and a striking plate 11 attached thereto. Generally, the main body 10 is consisted of a crown plate, a sole plate and a side plate. One of these plates of the main body 10 is selectively formed with a cast opening 120 and an inner flange 121 thereof in place. A prepared carbon-fiber plate 20 is regarded as a cover plate made of light material, and used to seal the cast opening 120 of the main body 10. Consequently, the main body 10 is accomplished to sharp its striking sound, to lower its center of gravity and its total weight by adjusting the assembled position, the dimensions and the weight of the carbon-fiber plate 20. Also, the main body 10 is accomplished to speed up the manufacturing process.

When the carbon-fiber plate 20 is fittingly adhered to the cast opening 120 of the main body 10, a plastic deformation may result in damage to a connection portion between the carbon-fiber plate 20 and the main body 10. To overcome the plastic deformation, the cast opening 120 is slightly greater than the carbon-fiber plate 20 to define a buffer groove (a) in which to fill with an elastic material (not shown) so the carbon-fiber plate 20 and the cast opening 120 are allowed deformable in the groove.

In casting process, however, the main body 10 of the golf club head is directly formed with the cast opening 120 and it is easily deformed during drawing and cooling of a pattern. In particular, the cast opening 120 is easily deformed due to without forming any mechanical support therein. In the follow-up assembling operation, the cast opening 120 is mismatched with the carbon-fiber plate 20 if the deformation of the cast opening 120 is greater than a predetermined tolerance. Meanwhile, when the carbon-fiber plate 20 is bonded to the deformed periphery of the cast opening 120, a buffer groove between the carbon-fiber plate 20 and the cast opening 120 has an irregular width that results in a decrease of product quality.

The present invention intends to provide a golf club head and a manufacturing method therefor, which is consisted of a cast body and a recession in which formed with a cut opening. By the use of the cut opening, the cast body of the golf club head can avoid deformation during drawing a pattern, thereby increasing precision of the dimensions, strength of the entire structure and quality of the products.

SUMMARY OF THE INVENTION

The primary objective of this invention is to provide a golf club head and a manufacturing method therefor, which is consisted of a cast body and a recession in which formed with a cut opening. Thereby, the cut opening of the golf club head can avoid structural deformation during drawing a pattern so that dimensional precision and product quality of the golf club head is increased.

The secondary objective of this invention is to provide the golf club head and the manufacturing method therefor, which includes a cut opening and a support rib formed therein for supporting the entire structure. Thereby, the golf club head is able to increase strength of the entire structure.

Another objective of this invention is to provide the golf club head and the manufacturing method therefor, which is formed with a buffer groove between a cover plate and a recession to be filled with an elastic material. Thereby, the elastic material is able to attenuate a striking force to avoid cracking in the recession of the golf club head so that strength and useful life of the golf club head is increased.

Another objective of this invention is to provide the golf club head and the manufacturing method therefor, which formed with a buffer groove to be filled with a colored elastic material. Thereby, the colored elastic material enhances the appearance of the golf club head and increases the added value of product.

Another objective of this invention is to provide the golf club head and the manufacturing method therefor, which is provided with a recession adapted to contain various cover plates. Thereby, the various cover plates contained in the recession of the golf club head may increase design choice in manufacture.

The manufacturing method for the golf club head in accordance with the present invention comprises steps of: casting a cast body provided with a recession thereon; cutting the cast body to form with at least one cut opening in the recession on the golf club head; adhering a carbon-fiber plate to the recession to seal the cut opening; defining a buffer groove between the carbon-fiber plate and the cast body, and filling with an elastic material into the buffer groove; processing the cast body to accomplish an end product.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 14:
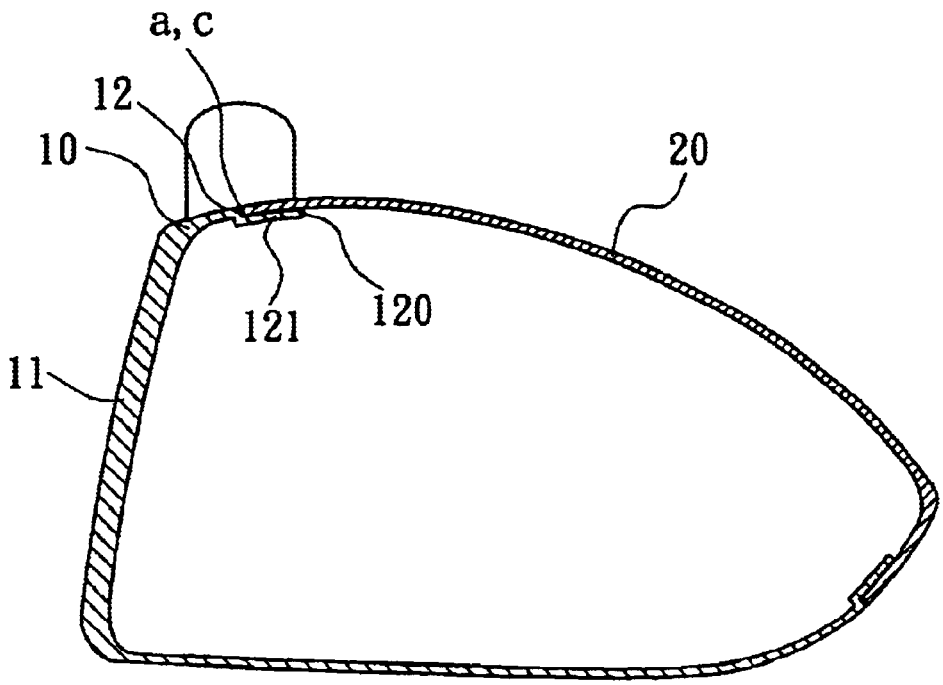
FIG. 14 a cross-sectional view of one of the side cover plates contained in the recession of the golf club head in accordance with the fourth embodiment of the present invention.
Figure 15:
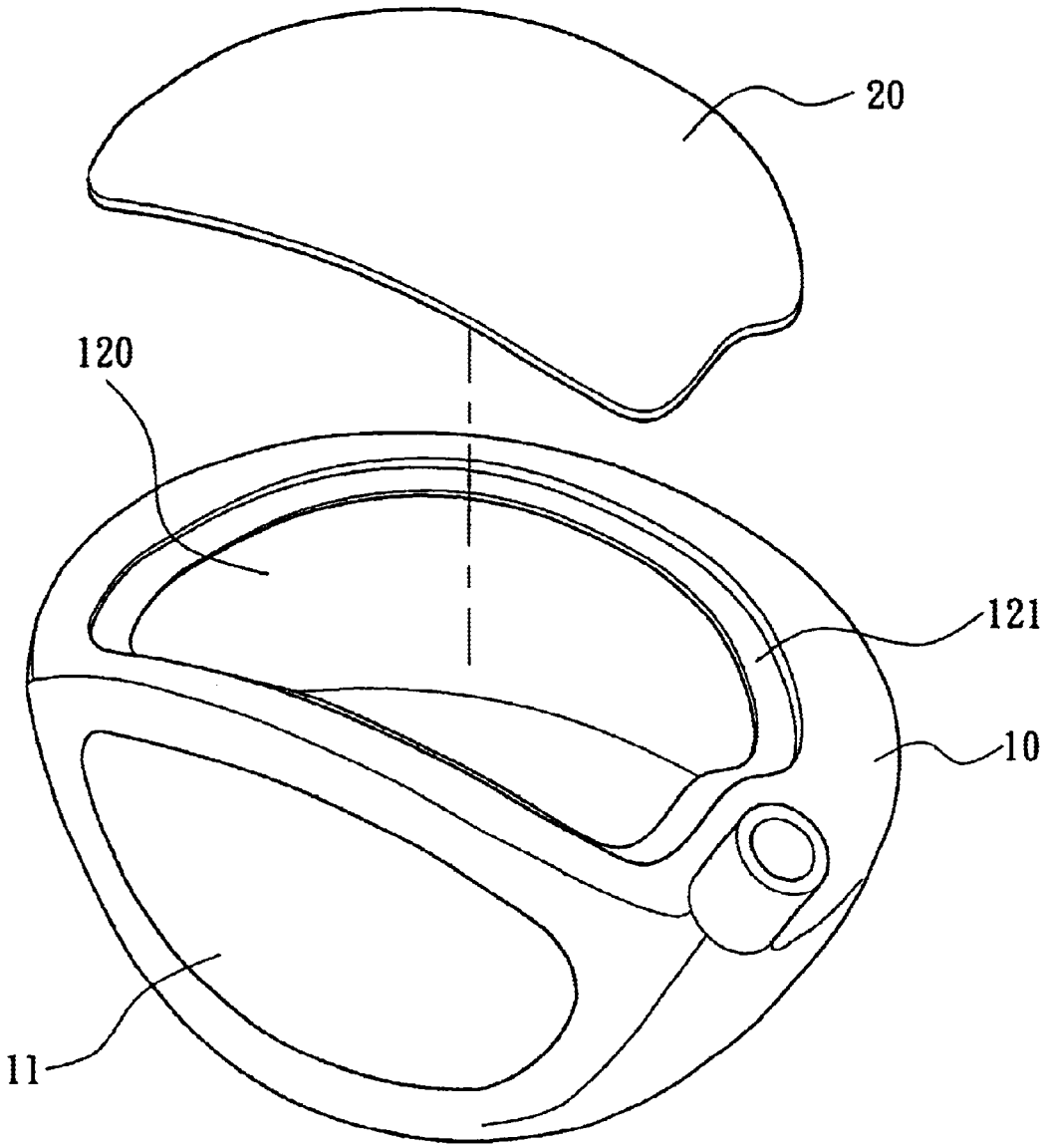
FIG. 15 PRIOR ART
FIG. 15 is an exploded perspective view of a conventional golf club head in accordance with the prior art.
Figure 16:
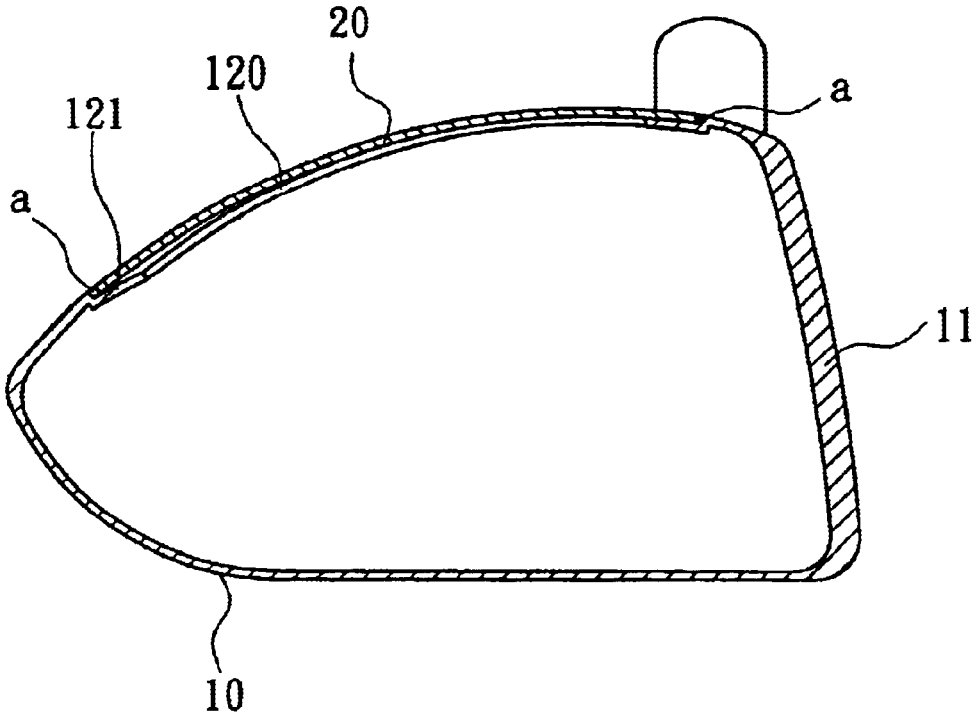
FIG. 16 PRIOR ART
FIG. 16 is a cross-sectional view of the conventional golf club head in accordance with the prior art.

Referring initially to FIGS. 1 through 14, reference numerals of the first through fourth embodiments of the present invention have applied the identical numerals of the conventional golf club head, as shown in FIGS. 15 and 16. The construction of the golf club head in accordance with the embodiments of the present invention have similar configuration and same function as that of the conventional golf club head and the detailed descriptions may be omitted.

Figure 1:
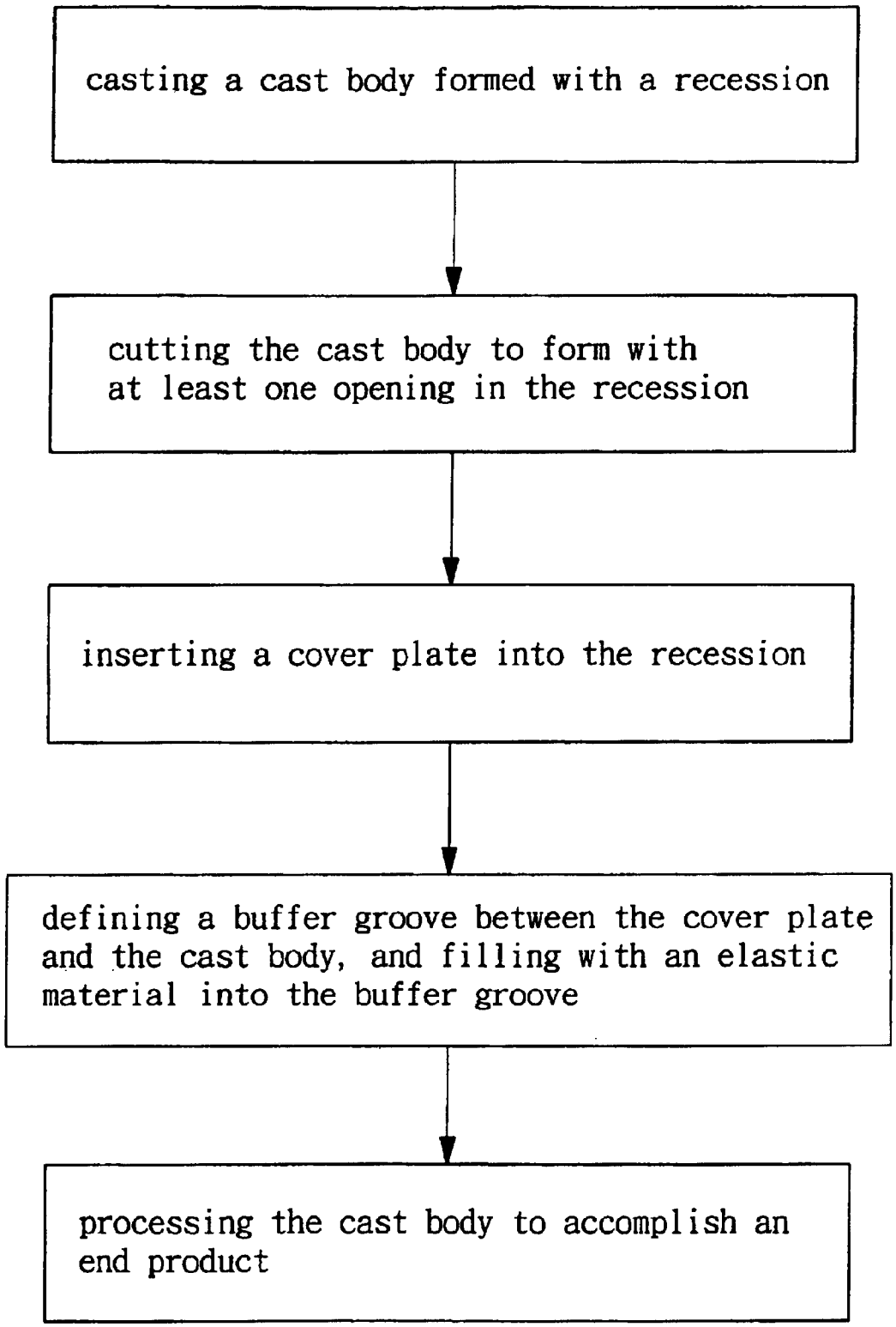
FIG. 1 is a block diagram of a golf club head and a manufacturing method therefor in accordance with the present invention.
Figure 2:
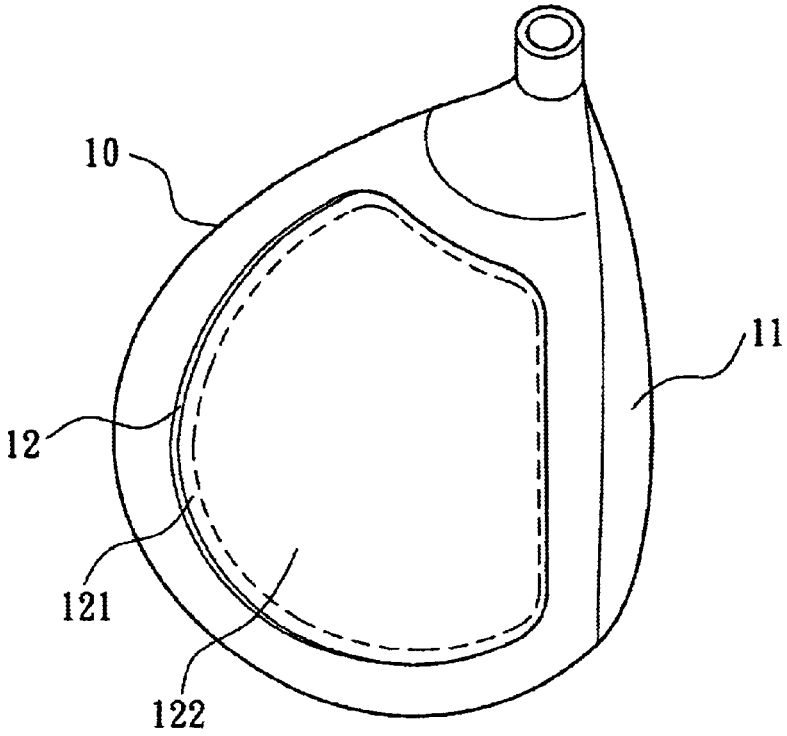
FIG. 2 is a top view of the golf club head in accordance with a first embodiment of the present invention.
Figure 3:
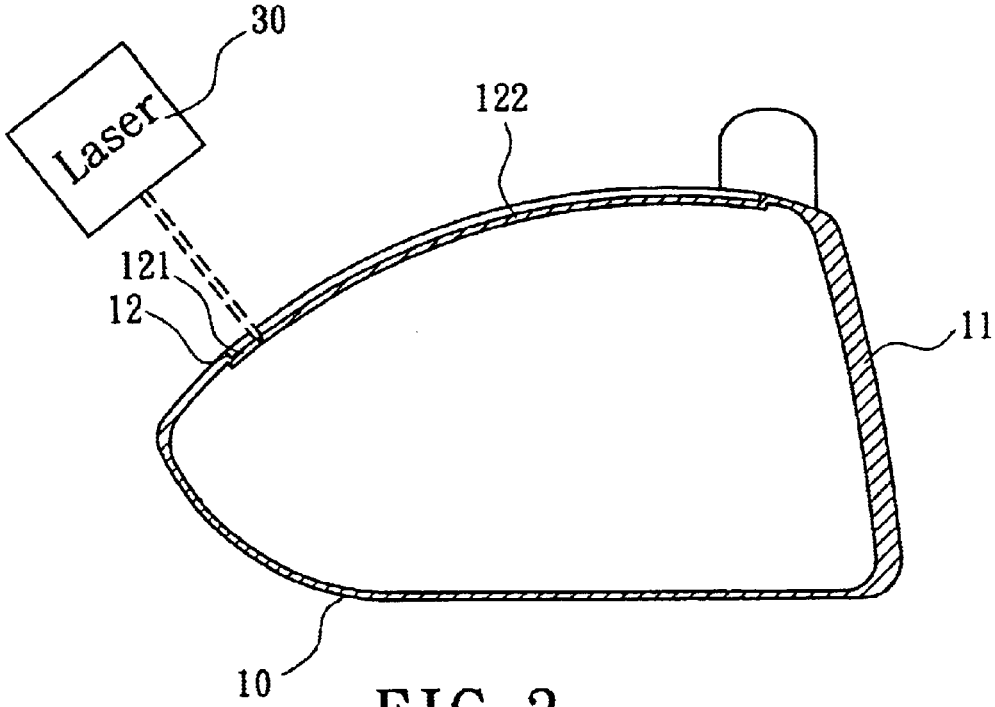
FIG. 3 is a cross-sectional view of a laser beam processing on a cast body of the golf club head in accordance with the first embodiment of the present invention.
Figure 4:
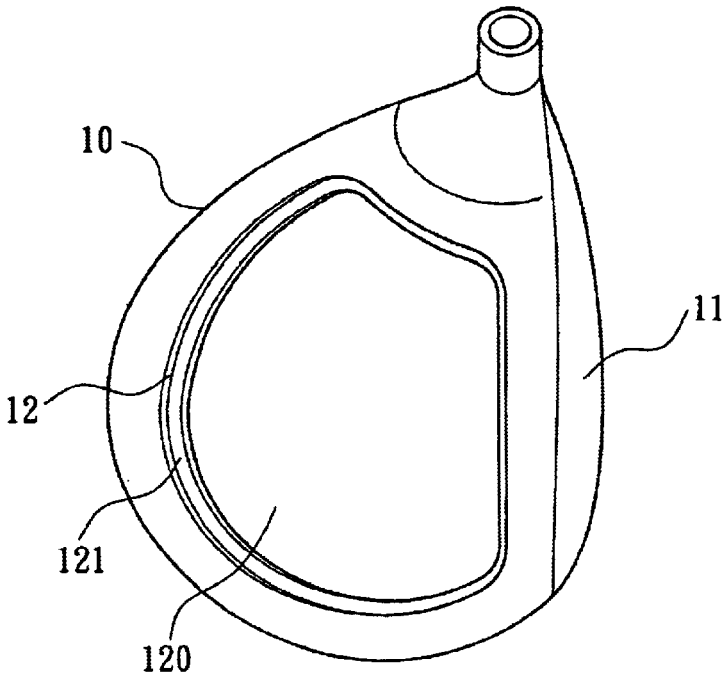
FIG. 4 is a top view of forming a cut opening on the golf club head in accordance with the first embodiment of the present invention after a cutting process.

Referring to FIGS. 1 and 2, a manufacturing method for a golf club head in accordance with the first embodiment of the present invention comprises a first step that casts a cast body 10 and a recession 12 formed thereon. Preferably, the cast body 10 is cast as a single member and made of material selecting from steel, titanium alloy, soft steel which are specific hardness material of metal or alloy. A front surface of the cast body 10 is connected to a striking plate 11 by welding manner, integrating manner or embedding manner. The amount of the recession 12 is selected and formed on one of plates including a crown plate, a sole plate and a side plate. Preferably, the recession 12 is provided with a stepped edge 121 which is adapted to accommodate a predetermined cover plate 20, such as a carbon-fiber plate, in the following process. Meanwhile, the stepped edge 121 is integrally connected to a temporary support 122, such as a cast crown support. The cast crown support is formed as a bottom part of the recession 12. In drawing operation, the recession 12 supported by the temporary support 122 can avoid deformation.

Referring to FIGS. 1 through 4, the manufacturing method for the golf club head in accordance with the first embodiment of the present invention comprises a second step that cuts at least one cut opening 120 to remove the temporary support 122 from the recession 12. In drawing operation, the recession 12 is temporarily supported by the temporary support 122. When the metal cast body 10 of the golf club head is cooled and hardened, this allows the removal of the temporary support 122 (as well as an unwanted portion) by cutting it to form the cut opening 120 in the recession 12. In cutting operation, a laser beam cutting machine 30, a plasma arc cutting machine and a water-jet cutting machine are available. Extending an annular edge within the recession 12 is the cut opening 120 which is corresponding to the stepped portion 121. In following operation, the stepped portion 121 of the recession 12 is adapted to accommodate a predetermined size of the cover plate 20.

Figure 5:
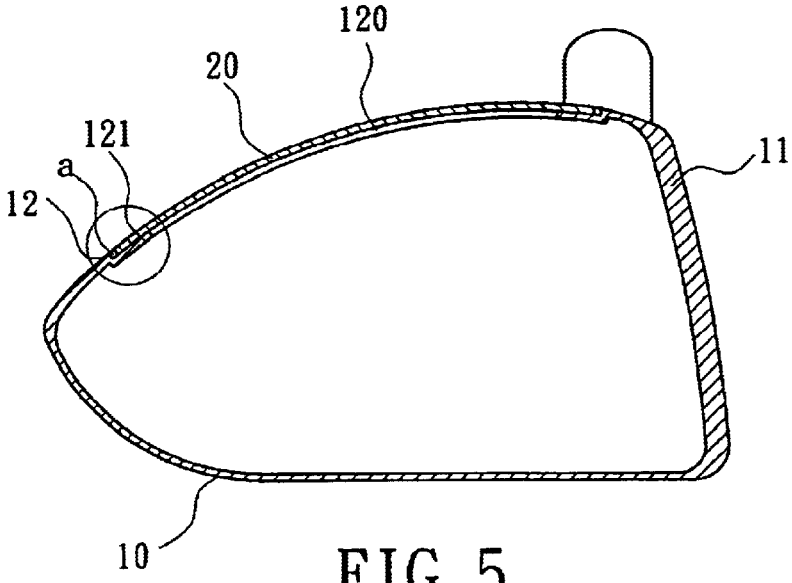
FIG. 5 is a cross-sectional view of a crown plate contained in recession of the golf club head for forming a groove between the cover plate and the cast body in accordance with the first embodiment of the present invention.

Referring to FIGS. 1 and 5, the manufacturing method for the golf club head in accordance with the first embodiment of the present invention comprises a third step that inserting the prepared cover plate 20 into the recession 12. Preferably, the prepared cover plate 20 is made of carbon fiber. In order to speed up the assembling process, the prepared cover plate 20 is prefabricated. In preparing operation, a plurality of carbon-fiber fabric sheets, preferably 4 through 10 layers, are interlaced in grains in a preferred included angle of 0 degrees, 45 degrees, 90 degrees, and 315 degrees, and piled up each other. In hardening heat-treatment, a heater (not shown) heats the carbon-fiber fabric sheets at 130 degrees Centigrade 20 minutes. After the carbon-fiber fabric sheets are hardened, the carbon-fiber cover plate 20 is formed with predetermined dimensions.

Furthermore, the present invention can be chosen to employ a bladder (not shown) contained in the cast body 10 to support the carbon-fiber fabric sheets in the recession 12. First, the carbon-fiber fabric sheets and the cast body 10 are fixed in a molding assembly (not shown). Second, the bladder contained in the cast body 10 is inflated so that the bladder is closely in contact with the carbon-fiber fabric sheets. Third, the carbon-fiber fabric sheets are heated and hardened to have the cover plate 20 with an appropriated configuration corresponding to that of the recession 12 of the cast body 10.

As shown in FIG. 5, according to design choice, the amount and dimensions of the recessions 12 and the cover plates 20 are changeable, and thus the center of gravity and its weight of the cast body 10 are adjustable. The major part of the cast body 10 is made of metal so that an inherent feature of sharpening the striking sound is still remained. Preferably, the material of the cover plate 20 can be selected from a group consisted of light metal (specific gravity less than 4.0 for example) and nonmetal (high polymer plastic or high strength glass fiber for example).

Figure 6:
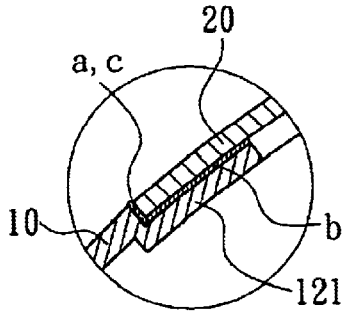
FIG. 6 is an enlarged view, in FIG. 5, of filling an elastic material into the groove formed between the cover plate and the cast body in accordance with the first embodiment of the present invention.

Referring to FIGS. 1, 5 and 6, the manufacturing method for the golf club head in accordance with the first embodiment of the present invention comprises a fourth step that forms a buffer groove (a) between an outer periphery of the cover plate 20 and an inner periphery of the recession 12. The buffer groove (a) is filled with an elastic material (c). To accomplish this task, there are two manufacturing methods for the buffer groove (a). First, the outer periphery of the cover plate 20 is slightly less than the inner periphery of the recession 12 so that the buffer groove (a) is directly formed therebetween. Second, the outer periphery of the cover plate 20 is nearly equal to the inner periphery of the recession 12 and a CNC process is adapted to mill on at least one side or either side of the peripheries. The buffer groove (a) is provided with an adequate space for the deformation of the cover plate and the recession 12, thereby wrinkles can be avoided in the assembling operation and product quality is raised. Preferably, changing the trace and configuration of the buffer groove can enhance appearance of the golf club head.

The elastic material (c) has various color and is selected from a group consisted of thermoplastic, rubber and high polymer (PU filler). When the elastic material (c) is hardened in the buffer groove (a), it is functioned to absorb vibration without affecting the buffer function of the buffer groove (a). Thereby, a coating or an adhesive (b) formed on the cast body 10 and the crown plate 20 can be avoided cracking that may increase appearance and added value. Furthermore, in addition to changing the configuration of the recession 12 and the cover plate 20, changing the color of the elastic material (c) may increase its appearance and added value.

Referring to FIGS. 1, 5 and 6, the manufacturing method for the golf club head in accordance with the first embodiment of the present invention comprises a fifth step that finishes the cast body 10 to accomplish an end product. A precision finishing process is adapted to polish an outer surface of the golf club head to remove the remaining resin or carbon fiber after the cover plate 20 is mounted in the recession 12. Subsequent to removal of the remaining resin or carbon fiber, a coating and painting process is treated on the golf club head.

Figure 7:
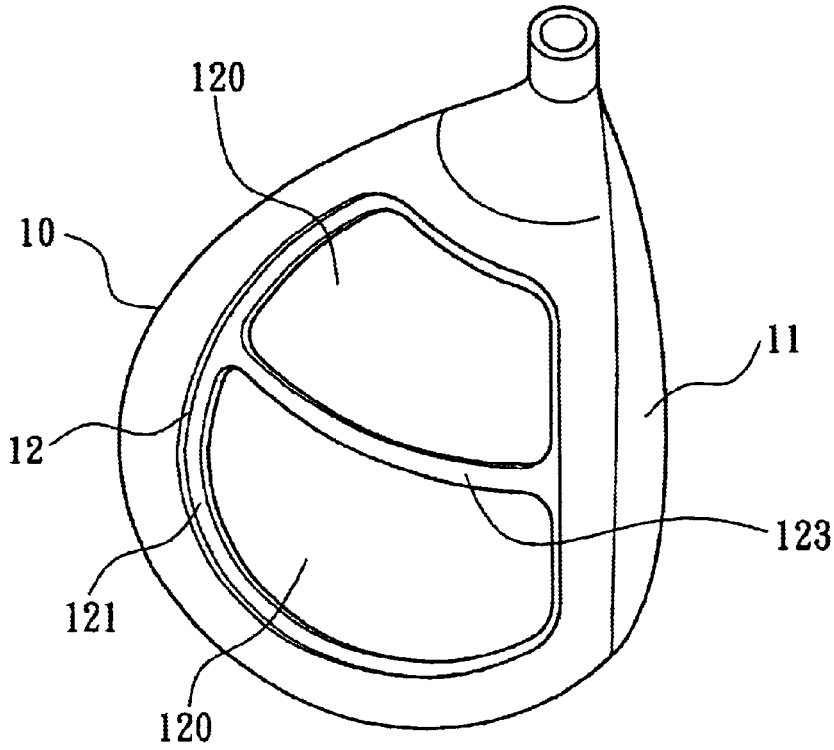
FIG. 7 is a top view of forming a pair of cut openings and a support rib thereof on a cast body of the golf club head in accordance with a second embodiment of the present invention.
Figure 8:
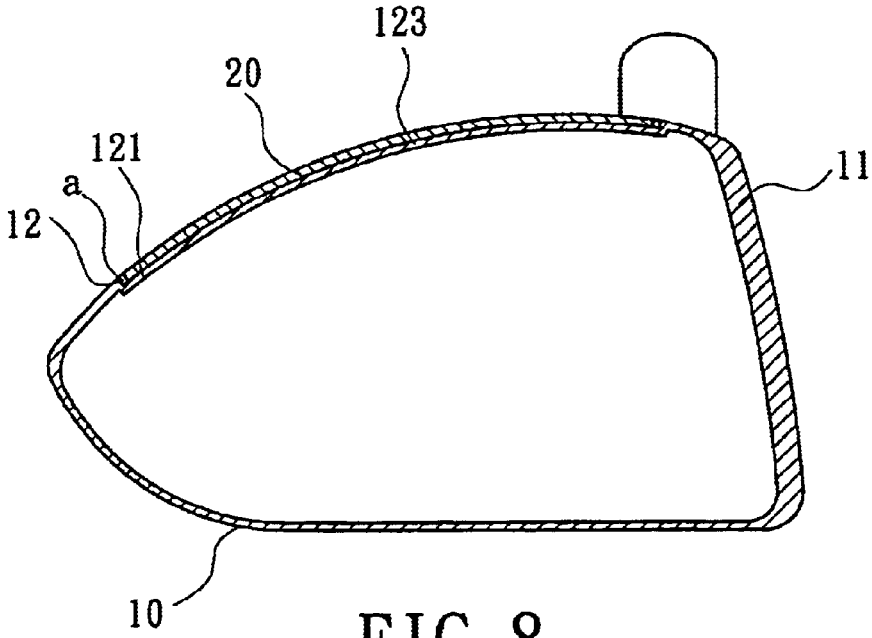
FIG. 8 is a cross-sectional view of a crown plate contained in a recession of the golf club head for forming a groove between the cover plate and the cast body in accordance with the second embodiment of the present invention.

Referring to FIGS. 1, 7 and 8, the manufacturing method for the golf club head in accordance with the second embodiment of the present invention comprises a second step that cuts a plurality of cut openings 120 by a laser beam cutting machine, a plasma arc cutting machine and a water-jet cutting machine. In comparison with the first embodiment, at least one support rib 123 is remained in the recession 12 of the cast body 10 to form a permanent support and has two ends integrally connected to the stepped portion 121.

When the cover plate 20 is assembled in the recession 12, the support rib 123 is adapted to reinforce the entire structure of the golf club head without adding any specific weight.

Figure 9:
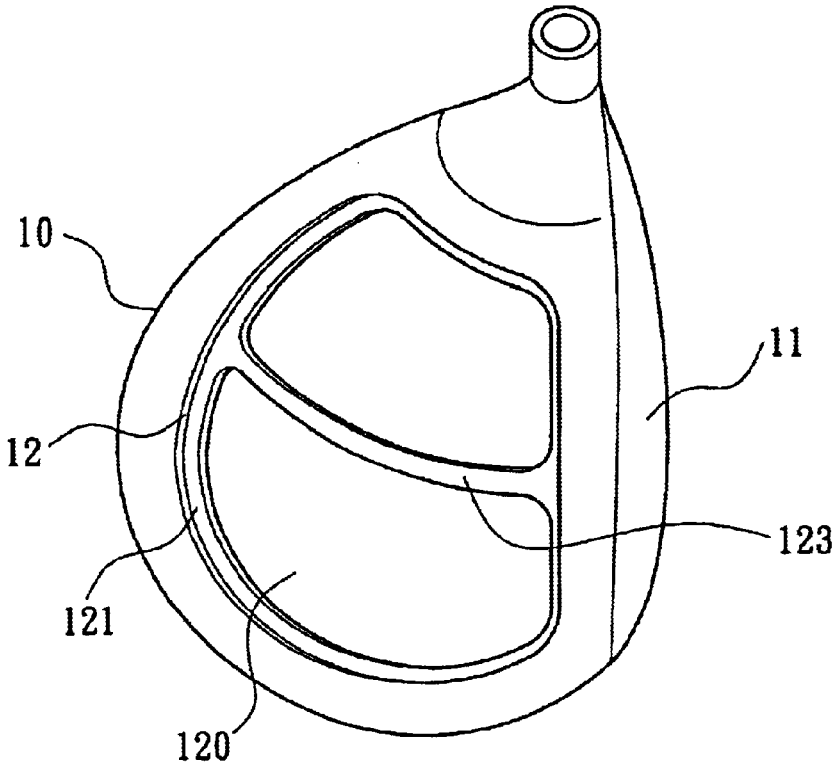
FIG. 9 is a top view of a cast of a golf club head formed with a pair of cast openings and a support rib thereof in accordance with a third embodiment of the present invention.
Figure 10:
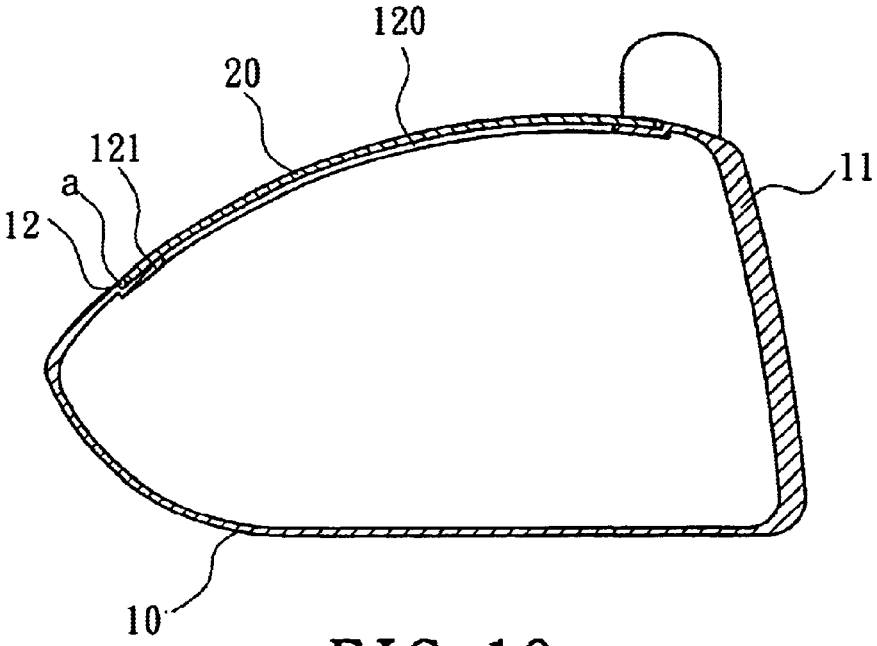
FIG. 10 a cross-sectional view of a crown plate contained in a recession of the golf club head for forming a groove between the cover plate and the cast body in accordance with the third embodiment of the present invention.
Figure 11:
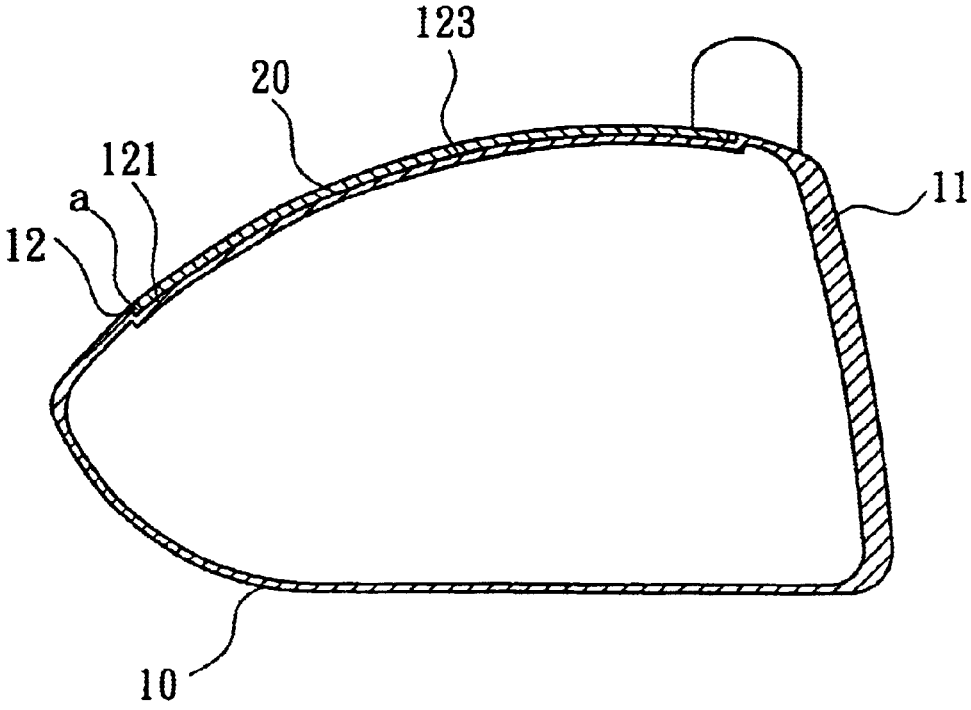
FIG. 11 another cross-sectional view, taken along the support rib, of the groove formed between the cover plate and the cast body in accordance with the third embodiment of the present invention.

Referring to FIGS. 1, 9 through 11, the manufacturing method for the golf club head in accordance with the third embodiment of the present invention comprises a first step that casts a cast body 10 and a recession 12. In comparison with the first and second embodiments, the cast body 10 is cast to form with a pair of cast opening 12 and at least one support rib 123. Similarly, the support rib 123 is used to connected with a stepped edge 121 and to support it in drawing operation that may avoid deformation. As shown in FIGS. 9 and 10, when the support rib 123 is regarded as a temporary support member as well as a removable portion, it is cut to remove prior to the cover plate 20 mounted in the recession 11. As shown in FIGS. 9 and 11, when the support rib 123 is regarded as a permanent support member, the support rib 123 is adapted to combine with the cover plate 20 by adhesive and to reinforce the entire structure of the golf club head.

Figure 12:
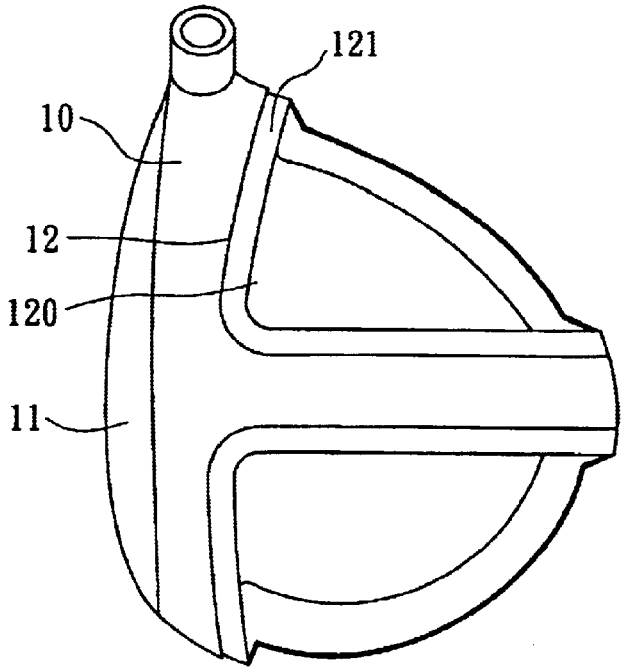
FIG. 12 a top view of forming a pair of cut openings on a cast body of the golf club head in accordance with the fourth embodiment of the present invention after a cutting process.
Figure 13:
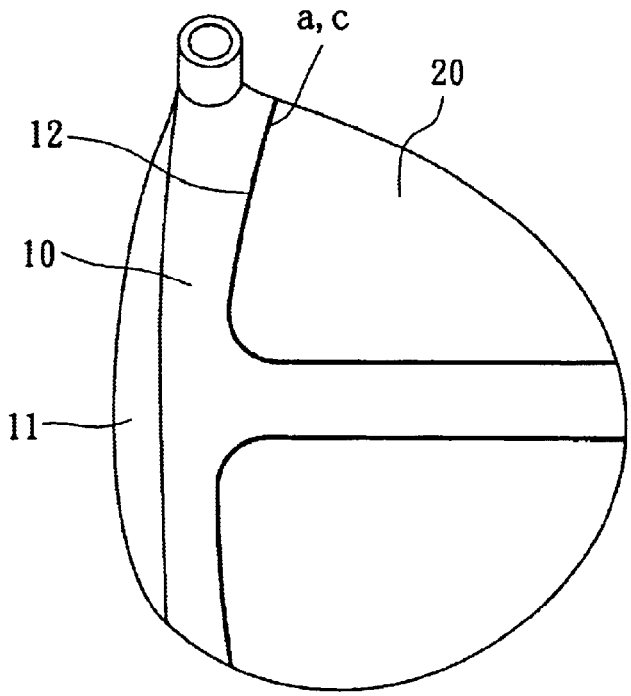
FIG. 13 a top view of a pair of side cover plates contained in a pair of recessions of the golf club head in accordance with the fourth embodiment of the present invention.

Referring to FIGS. 12 through 14, the golf club head in accordance with the fourth embodiment of the present invention comprises a cast body 10, a pair of recessions 12 and a pair of side cover plates 20. In comparison with the first through third embodiments, each of the side cover plates 20 of the fourth embodiment is extended from a crown portion to a side portion. In design choice, changing the dimensions of the side cover plate 20 accomplishes an adjustment in its total weight and its center of gravity. Also, changing the configuration of the side cover plate 20 accomplishes enhancement of its appearance and an increase in its added value.

Referring again to FIGS. 15 and 16, the cast opening 120 of the conventional main body 10 cannot be contained in deformation. Referring again to FIGS. 4, 7, 9 and 12, by contrast, the golf club head of the present invention has the recession 12 of the cast body 10 that accomplishes reinforcement in the entire structure, an enhancement in the appearance and an increase in the added value.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A manufacturing method for a golf club head, comprising the steps of:

casting a body formed with a recession, said recession integrally provided with a support rib which supports the recession to avoid deformation;

defining a stepped portion along the edges of the body delimiting the recession;

cutting said support rib of the body, said recession and the step portion defining the at least one opening;

depositing an adhesive along the stepped portion;

inserting a cover plate into the recession in a substantially abutting relation with the stepped portion to seal the opening, said opening having a dimension greater than the cover plate to form a buffer groove between the cover plate and the body; and depositing an elastic material along the buffer groove, the elastic material selected from the group consisting of thermoplastic, rubber, high polymer and PU filler.

2. The manufacturing method as defined in claim 1, wherein the recession is provided with the support rib which is integrally connected to an inner edge of the recession, the support rib being formed during the casting step.

3. The manufacturing method as defined in claim 1, wherein the cut opening is processed with a laser beam cutting machine, a plasma arc cutting machine or a water-jet cutting machine.

4. The manufacturing method as defined in claim 1, wherein the cover plate is a carbon-fiber plate which is prefabricated.

5. The manufacturing method as defined in claim 1, wherein the cover plate is made of light metal, high polymer plastic or high strength glass fiber.

6. A golf club head comprising:

a body including a striking plate, and defining at least one recession and a support rib integrally formed therein, said support rib shaped to a desired configuration running across a crown portion of the body for reinforcing the entire structure of the crown portion, the body further defining a stepped portion located along the edges of the body delimiting the recession;

at least one cover plate being inserted into the recession to thereby form a buffer groove between an outer periphery of the cover plate and an inner periphery of the recession, said support rib abutting against the cover plate for precise positioning in the recession;

an adhesive securing the body to the cover plate, the adhesive deposited along the stepped portion, and located between the stepped portion and the cover plate; and an elastic material positioned within the buffer groove, and between the body and the cover plate, the elastic material selected from the group consisting of thermoplastic, rubber, high polymer and PU filler.

7. The golf club head as defined in claim 6, wherein the cover plate is a carbon-fiber plate which is prefabricated.

8. The golf club head as defined in claim 6, wherein the cover plate is made of light metal, high polymer plastic or high strength glass fiber.

* * * * *